US008424128B2

(12) United States Patent
Dvorak

(10) Patent No.: US 8,424,128 B2
(45) Date of Patent: Apr. 23, 2013

(54) DRAWER CONTAINING A SINK

(76) Inventor: Steven G. Dvorak, Houston, TX (US)

( * ) Notice: Subject to any disclaimer, the term of this patent is extended or adjusted under 35 U.S.C. 154(b) by 393 days.

(21) Appl. No.: 12/891,686

(22) Filed: Sep. 27, 2010

(65) Prior Publication Data

US 2011/0080076 A1 Apr. 7, 2011

Related U.S. Application Data

(60) Provisional application No. 61/247,930, filed on Oct. 1, 2009.

(51) Int. Cl.
*A47B 77/06* (2006.01)

(52) U.S. Cl.
USPC ..... 4/630

(58) Field of Classification Search ..... 4/630
See application file for complete search history.

(56) References Cited

U.S. PATENT DOCUMENTS 4,130,123 A * 12/1978 Wines et al. ..... 134/56 R
5,813,063 A * 9/1998 Watkins et al. ..... 4/626

* cited by examiner

*Primary Examiner* — Huyen Le
(74) *Attorney, Agent, or Firm* — Gordon G. Waggett, P.C.

(57) ABSTRACT

A drawer is disclosed which is installed in a cabinet structure containing plumbing comprising water lines and a waste line. The drawer comprises a sink which is disposed in the drawer proximate the top of the drawer near one side of the drawer and the sink comprises a fold-down faucet, valves and a drain. The drawer also comprises a plumbing mount plate for connection to the water and a waste line in the cabinet structure. Flexible tubing connects the valves and drain of the sink to the plumbing mount plate.

1 Claim, 4 Drawing Sheets

DRAWER CONTAINING A SINK

CROSS-REFERENCE TO RELATED APPLICATION

The present application claims the benefit of the filing date of U.S. Provisional Application No. 61/247,930 filed Oct. 1, 2009.

BACKGROUND OF THE INVENTION

1. Field of the Invention

The present invention relates to a drawer containing a sink for installation in a cabinet structure.

2. Description of the Prior Art

Modern kitchen design often includes a "veggie" utility sink in addition to the main kitchen sink. These utility sinks provide the convenience of having a secondary area in which to prepare food, and these utility sinks may be installed in the top of an island in the kitchen or in a cabinet countertop in the kitchen. Such utility sinks have the disadvantage, however, of always taking up space on the countertop or top of the island when the sink is not in use.

SUMMARY OF THE INVENTION

In accordance with the present invention, a drawer is provided which is installed in a cabinet structure having a back wall containing plumbing comprising water lines and a waste line. The drawer has front, back, and first and second side panels and a top, and comprises a plumbing mount plate. The plumbing mount plate comprises a back plate, an anchor plate, and three telescoping connection tubes each having first and second ends. The back plate is secured to the back wall of the cabinet structure and to the three telescoping connection tubes proximate their first ends. The first ends of two of the telescoping connection tubes are connected to the water lines in the cabinet structure, and the first end of the third telescoping connection tube is connected to the waste line in the cabinet structure. The anchor plate is secured to the three telescoping connection tubes proximate their second ends, and each of the second ends of the three telescoping connection tubes have plumbing connections.

A drawer in accordance with the present invention further comprises a sink which is disposed in the drawer proximate the top of the drawer near one side panel of the drawer. The sink comprises a fold-down faucet and valves through which water may be provided to the site, a concavity for receiving water, and a drain to permit water to flow out of the concavity. Flexible tubing is provided which connects the valves of the sink to the second ends of the telescoping connection tubes that are connected to the water lines in the cabinet structure and which connects the drain of the sink to the second end of the telescoping connection tube that is connected to the waste line in the cabinet structure.

DESCRIPTION OF THE SPECIFIC EMBODIMENTS

Figure 1:
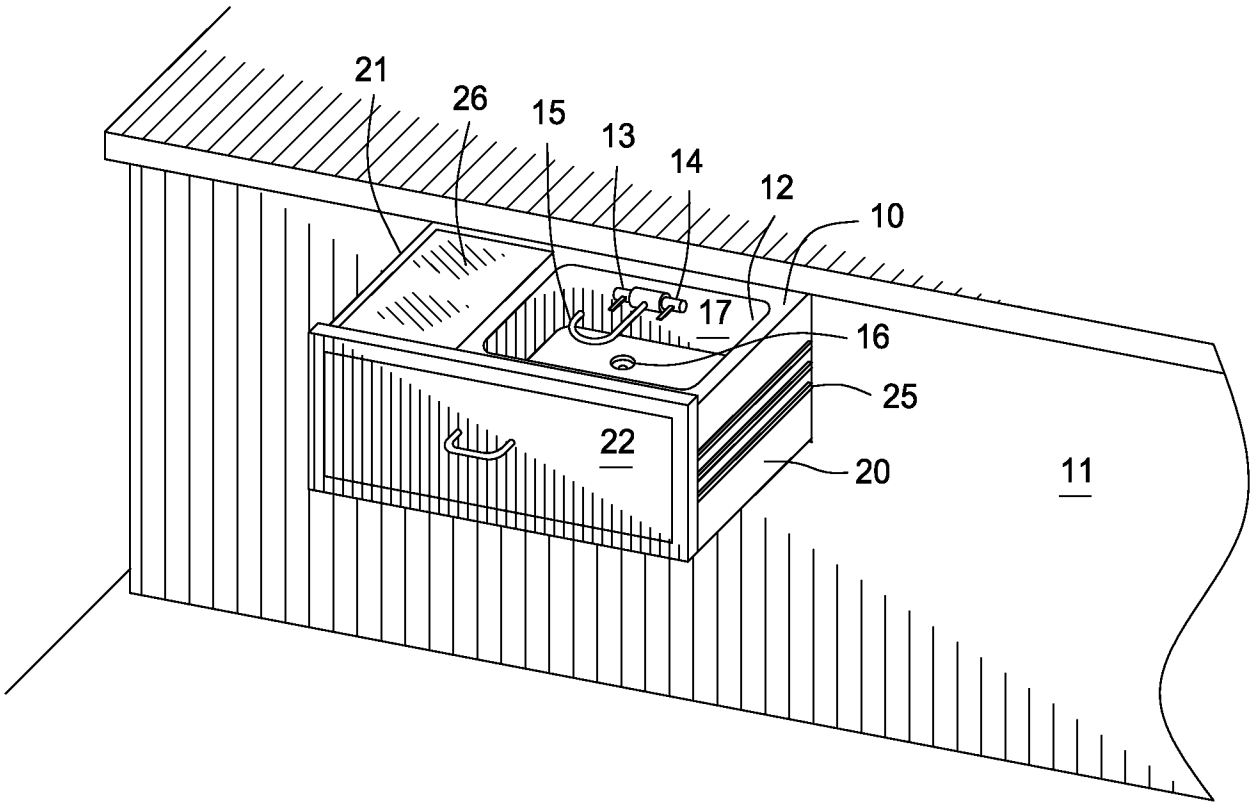
FIG. 1 is a perspective drawing which illustrates a drawer in accordance with the present invention.
Figure 2:
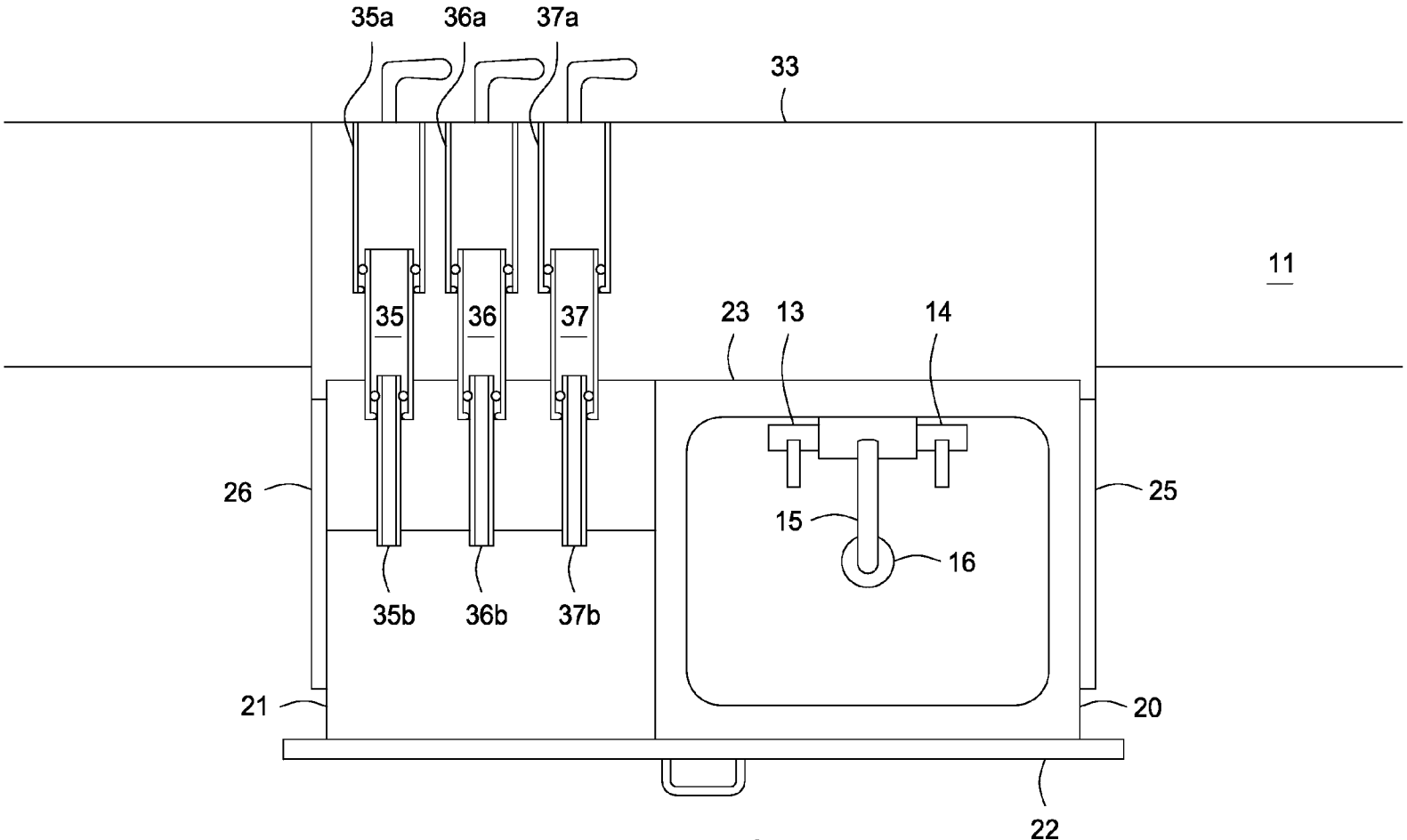
FIG. 2 is a top view of a drawer in accordance with the present invention.
Figure 3:
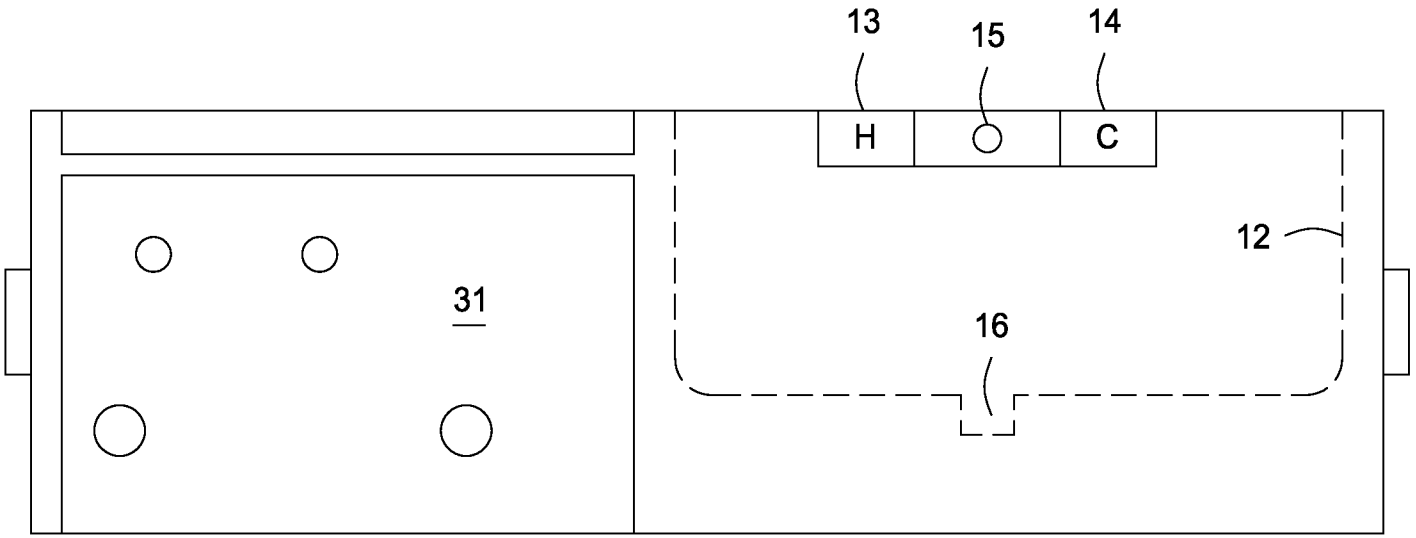
FIG. 3 is a partially exposed front view of a drawer in accordance with the present invention.
Figure 4:
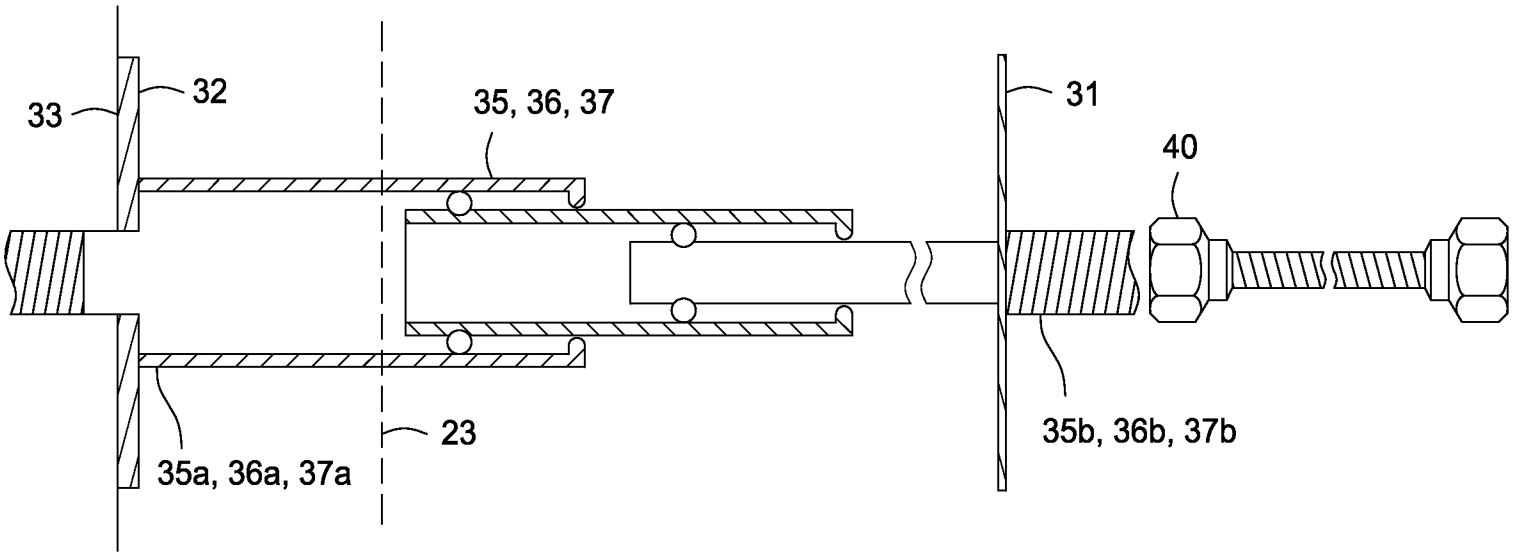
FIG. 4 is a pictorial view in partial cross-section of the telescoping connection tubes utilized in a drawer in accordance with the present invention.

It will be appreciated that the present invention may take many forms and embodiments. In the following description, some embodiments of the invention are described and numerous details are set forth to provide an understanding of the present invention. Those skilled in the art will appreciate, however, that the present invention may be practiced without those details and that numerous variations and modifications from the described embodiments may be possible. The following description is thus intended to illustrate and not to limit the present invention.

With reference to one FIGS. 1-4, a drawer 10 in accordance with the present invention is installed in an opening in cabinet structure 11. Cabinet structure 11 may, for example, comprise an island or a kitchen counter having a back wall 33 in which plumbing comprising water lines and a waste line are located. The drawer 10 comprises a front panel 22, side panels 20 and 21 and back wall 23, and drawer glides 25 and 26 to facilitate movement of drawer 10 in and out of cabinet structure 11.

A sink 12 is disposed in drawer 10 proximate the top of the drawer near one of the side panels of the drawer, and the sink 12 may be fabricated from any suitable material which is normally used for such apparatus including metal, porcelain, vitreous clay, plastic and the like. The sink 12 comprises a fold-down faucet 15 through which water may be provided to sink 12 and valves 13 and 14 for controlling the flow of water through faucet 15. The sink 12 further comprises a concavity 17 for receiving water and a drain 16 to permit water to flow out of the concavity 17.

Drawer 10 also comprises a plumbing mount plate which comprises a back plate 32, an anchor plate 31 and three telescoping connection tubes 35-37, were each telescoping connection tube 35-37 has first ends 35*a*, 36*a* and 37*a* and second ends 35*b*, 36*b* and 37*b*, respectively. The back plate 32 is secured to the back wall 33 of cabinet structure 11 and to the three telescoping connection tubes 35-37 proximate their first ends 35*a*, 36*a* and 37*a*. The first ends 35*a* and 36*a* of telescoping connection tubes 35 and 36 are connected to the water lines in the cabinet structure 11, and the first and 37*a* of telescoping connection tube 37 is connected to the waste lien in the cabinet structure 11. The anchor plate 31 is secured to telescoping connection tubes 35-37 proximate their second ends 35*b*, 36*b* and 37*b*, respectively.

Drawer 10 in accordance with the present invention three lengths of flexible tubing 40 which are respectively used to: (a) connect the second end 35*b* of telescoping connection tube 35 to valve 13 of sink 12; (b) connect the second end 36*b* of telescoping connection tube 36 to valve 14 of sink 12; and (c) connect the second end 37*b* of telescoping connection tube 37 to drain 16 of sink 12.

With reference to FIG. 1, drawer 10 in accordance with the present invention made for the comprise cutting board 26 which is removable to permit access to the plumbing mount plate.

What is claimed is:

1. A drawer which is installed in an opening in a cabinet structure where the opening has a back wall in which water lines and a waste line are located ad where the drawer has front, back, and first and second side panels and a top, comprising:

a plumbing mount plate comprising a back plate, an anchor plate and three telescoping connection tubes each having first and second ends, wherein: (i) the back plate is secured to the back wall of the cabinet structure and to the three telescoping connection tubes proximate their first ends; (ii) the first ends of two of said telescoping connection tubes are connected to the water lines in the back wall of the cabinet structure; (iii) the first end of the third telescoping connection tube is connected to the waste line in the back wall of the cabinet structure; (iv) the anchor plate is secured to the three telescoping connection tubes proximate their second ends and (v) each of the second ends of the three connection tubes have plumbing connections;

a sink which is disposed in the drawer proximate the top of the drawer near one side panel of the drawer, the sink comprising a fold-down faucet and valves through which water may be provided to the sink, a concavity for receiving water, and a drain to permit water to flow out of the concavity; and flexible tubing which connects the valves of the sink to the to second ends of the telescoping connection tubes that are connected to the water lines in the back wall of the cabinet structure and which connects the drain of the sink to the second end of the telescoping connection tube that is connected to the waste line in the back wall of the cabinet structure.

* * * * *